US010641117B2

(12) United States Patent
Bergman et al.

(10) Patent No.: US 10,641,117 B2
(45) Date of Patent: May 5, 2020

(54) MULTIPLE INJECTOR HOLES FOR GAS TURBINE ENGINE VANE

(71) Applicant: UNITED TECHNOLOGIES CORPORATION, Farmington, CT (US)

(72) Inventors: Russell J. Bergman, Glastonbury, CT (US); Charles C. Wu, Glastonbury, CT (US); Brett Alan Bartling, East Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 686 days.

(21) Appl. No.: 15/103,561

(22) PCT Filed: Nov. 6, 2014

(86) PCT No.: PCT/US2014/064213

§ 371 (c)(1),
(2) Date: Jun. 10, 2016

(87) PCT Pub. No.: WO2015/112227

PCT Pub. Date: Jul. 30, 2015

(65) Prior Publication Data

US 2016/0312631 A1 Oct. 27, 2016

Related U.S. Application Data

(60) Provisional application No. 61/914,991, filed on Dec. 12, 2013.

(51) Int. Cl.
*F01D 9/06* (2006.01)
*F01D 11/00* (2006.01)
(Continued)

(52) U.S. Cl.
CPC ..... *F01D 9/06* (2013.01); *F01D 5/082* (2013.01); *F01D 9/041* (2013.01); *F01D 9/065* (2013.01);
(Continued)

(58) Field of Classification Search
CPC . F01D 9/06; F01D 9/065; F01D 25/12; F01D 11/04; F01D 11/001; F01D 5/081;
(Continued)

(56) References Cited

U.S. PATENT DOCUMENTS 3,275,294 A * 9/1966 Allen ..... F01D 5/081 415/115
5,217,348 A 6/1993 Rup, Jr. et al.
(Continued)

FOREIGN PATENT DOCUMENTS

EP 2343443 A2 7/2011
EP 2474708 A2 7/2012
(Continued)

OTHER PUBLICATIONS

International Preliminary Report on Patentability for International Application No. PCT/US2014/064213 dated May 26, 2016.
(Continued)

*Primary Examiner* — Christopher Verdier
(74) *Attorney, Agent, or Firm* — Carlson, Gaskey & Olds, P.C.

(57) ABSTRACT

A vane comprises an airfoil extending from a radially outer platform to a radially inner platform. A pair of legs extend radially inwardly from the radially inner platform, and an air flow passage extends through the radially outer platform, through the airfoil, and into a chamber defined between the pair of legs. One of the pair of legs includes a plurality of
(Continued)

injector holes, configured to allow air from the radially outer platform to pass outwardly of the holes. A gas turbine engine is also disclosed.

13 Claims, 4 Drawing Sheets

(51) Int. Cl.
*F01D 11/04* (2006.01)
*F01D 5/08* (2006.01)
*F01D 9/04* (2006.01)
*F01D 25/12* (2006.01)

(52) U.S. Cl.
CPC ..... *F01D 11/001* (2013.01); *F01D 11/04* (2013.01); *F01D 25/12* (2013.01); *F05D 2220/32* (2013.01); *F05D 2240/12* (2013.01); *F05D 2240/81* (2013.01); *F05D 2260/20* (2013.01)

(58) Field of Classification Search
CPC ... F01D 5/082; F05D 2240/81; F05D 2260/20
USPC ..... 415/173.7
See application file for complete search history.

(56) References Cited

U.S. PATENT DOCUMENTS 5,344,283 A 9/1994 Magowan et al.
6,109,867 A 8/2000 Jacques Portefaix
7,921,654 B1 * 4/2011 Liang ..... F01D 5/186 415/115
2002/0159880 A1 10/2002 Morris et al.
2004/0033132 A1 * 2/2004 Iacopetti ..... F01D 11/001 415/174.2
2006/0034685 A1 2/2006 Kizuka et al.
2009/0155050 A1 * 6/2009 Broomer ..... F01D 9/04 415/115
2010/0124484 A1 * 5/2010 Tibbott ..... F01D 5/188 415/115
2010/0254801 A1 * 10/2010 Tibbott ..... F01D 5/186 415/115
2012/0177485 A1 * 7/2012 Virkler ..... F01D 5/3015 415/173.7
2013/0108441 A1 5/2013 Ingram

FOREIGN PATENT DOCUMENTS

EP 2503101 A2 9/2012
WO 9316275 A1 8/1993
WO 2009106464 9/2009
WO 2013117258 8/2013

OTHER PUBLICATIONS

International Search Report from corresponding PCT PCT/US14/64213.
Supplementary European Search Report for European Application No. 14879596.6 dated Oct. 14, 2016.

* cited by examiner

MULTIPLE INJECTOR HOLES FOR GAS TURBINE ENGINE VANE

CROSS-REFERENCE TO RELATED APPLICATION

This application claims priority to U.S. Provisional Patent Application No. 61/914,991, filed 12 Dec. 2013.

BACKGROUND

This application relates to injector holes for injecting air from a gas turbine engine vane into a space between a vane and an adjacent rotating blade.

Gas turbine engines typically include a fan delivering air into a compressor section. The air is compressed, and delivered into a combustion section where it is mixed with fuel and ignited. Products of this combustion pass downstream over turbine rotors, driving them to rotate.

Components in the turbine section are subject to very high temperatures due to the products of combustion. Thus, components within a hot gas flow path are provided with internal cooling air passages. In addition, to increase the efficiency of the gas turbine engine, it is desirable to force these hot gases to pass across the path of turbine rotors. The turbine rotors typically rotate with a plurality of blades, and there may be several stages of a turbine rotor. Static vanes are positioned axially intermediate the plural stages, and include airfoils which serve to direct the products of combustion from one stage to the next. There are seals between the rotating blades and the vanes, and in particular at radially inner platforms.

Air is provided from a radially outer chamber into a chamber radially inward of a radially inner platform in the vanes. That air then passes axially into a chamber defined between a vane stage and a rotor stage. The air is driven into a gap between the rotating blade and the vane to prevent leakage of the products of combustion radially inwardly through that gap.

SUMMARY

In a featured embodiment, a vane comprises an airfoil extending from a radially outer platform to a radially inner platform. A pair of legs extend radially inwardly from the radially inner platform, and an air flow passage extends through the radially outer platform, through the airfoil, and into a chamber defined between the pair of legs. One of the pair of legs includes a plurality of injector holes, configured to allow air from the radially outer platform to pass outwardly of the holes.

In another embodiment according to the previous embodiment, the plurality of holes includes a pair of holes, a first hole positioned radially outwardly of a second.

In another embodiment according to any of the previous embodiments, the pair of holes have distinct shapes.

In another embodiment according to any of the previous embodiments, the pair of holes have distinct sizes and cross-sectional areas.

In another embodiment according to any of the previous embodiments, at least one of the pair of holes extends at an angle that is non-parallel to a central axis of an engine incorporating the vane.

In another embodiment according to any of the previous embodiments, each of the pair of holes extends at an angle that is non-parallel to the center axis of the engine.

In another embodiment according to any of the previous embodiments, a second airfoil extends between the radially outer platform and the radially inner platform, and each of the airfoil and the second airfoil include a plurality of injector holes.

In another embodiment according to any of the previous embodiments, the holes associated with at least one of the airfoil and the second airfoil have distinct sizes and cross-sectional areas.

In another embodiment according to any of the previous embodiments, at least one of the holes associated with at least one of the airfoil and the second airfoil extends at an angle that is non-parallel to a central axis of an engine incorporating the vane.

In another embodiment according to any of the previous embodiments, each of the holes associated with at least one of the airfoil and the second airfoil extend at an angle that is non-parallel to the center axis of the engine.

In another featured embodiment, a gas turbine engine comprises at least one static vane stage. A vane in the at least one static vane stage includes a radially outer platform, a radially inner platform, and an airfoil extending from the radially outer platform to the radially inner platform. A pair of legs extends radially inwardly from the radially inner platform. The vane includes an air flow passage extending through the radially outer platform, through the airfoil, and into a chamber defined between the pair of legs. One of the pair of legs includes a plurality of injector holes associated with the airfoil, configured to allow air from the radially outer platform to pass outwardly of the holes.

In another embodiment according to the previous embodiment, the plurality of holes includes a pair of holes, a first hole positioned radially outwardly of a second.

In another embodiment according to any of the previous embodiments, the pair of holes have distinct shapes.

In another embodiment according to any of the previous embodiments, the pair of holes have distinct sizes and cross-sectional areas.

In another embodiment according to any of the previous embodiments, at least one of the pair of holes extends at an angle that is non-parallel to a central axis of an engine incorporating the vane.

In another embodiment according to any of the previous embodiments, each of the pair of holes extend at an angle that is non-parallel to the center axis of the engine.

In another embodiment according to any of the previous embodiments, a second airfoil extends between the radially outer platform and the radially inner platform. Each of the airfoil and the second airfoil include a plurality of injector holes.

In another embodiment according to any of the previous embodiments, the holes associated with at least one of the airfoil and the second airfoil have distinct sizes and cross-sectional areas.

In another embodiment according to any of the previous embodiments, at least one of the holes associated with at least one of the airfoil and the second airfoil extends at an angle that is non-parallel to a central axis of an engine incorporating the vane.

In another embodiment according to any of the previous embodiments, each of the holes associated with at least one of the airfoil and the second airfoil extend at an angle that is not-parallel to the center axis of the engine.

These and other features of this disclosure may be best understood from the following drawings and specification, the following of which is a brief description.

DETAILED DESCRIPTION

Figure 1:
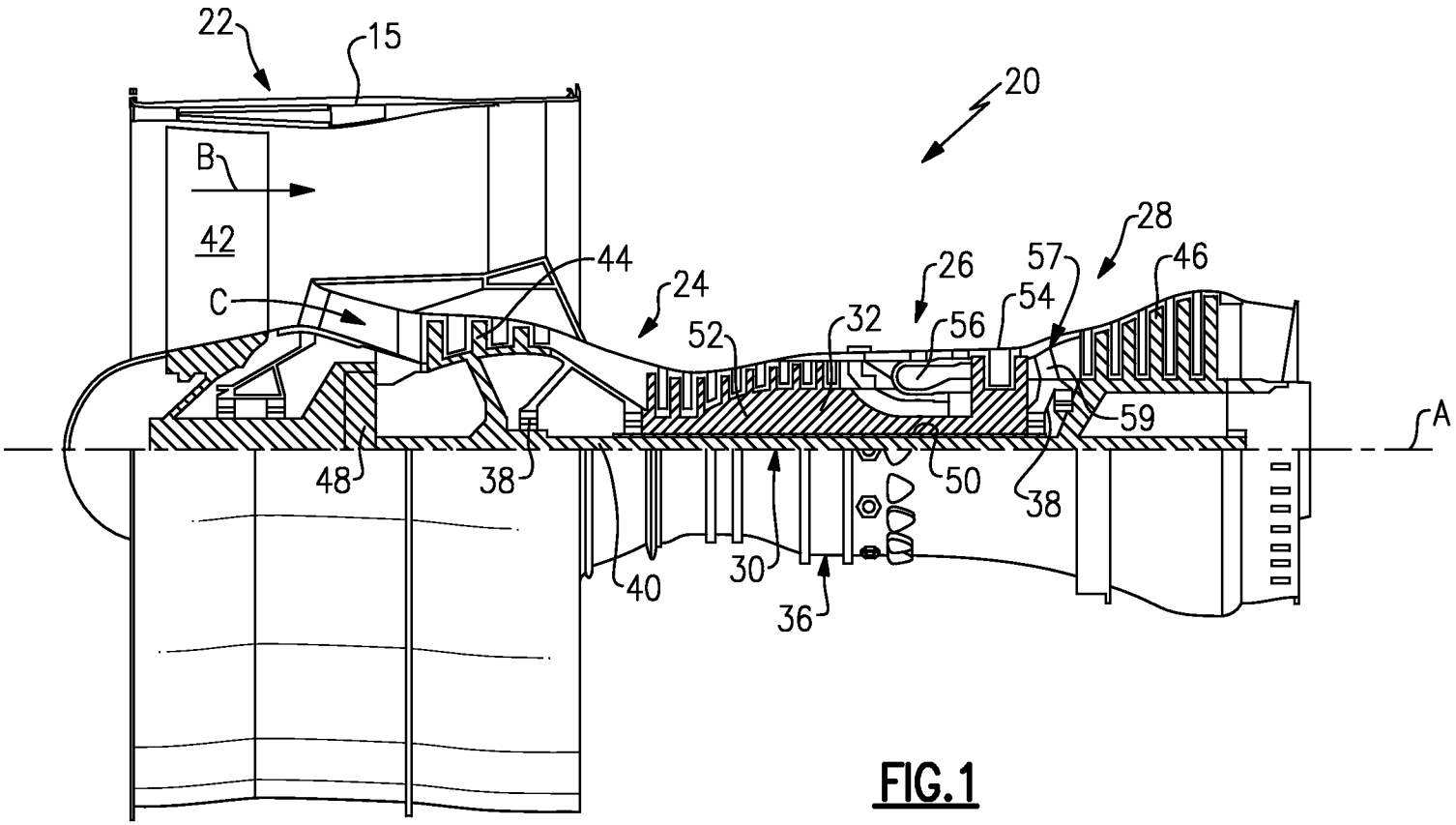
FIG. 1 schematically shows an engine, according to an embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{05}$. The "Low corrected fan tip speed" as disclosed herein according to one non-limiting embodiment is less than about 1150 ft/second.

Figure 2:
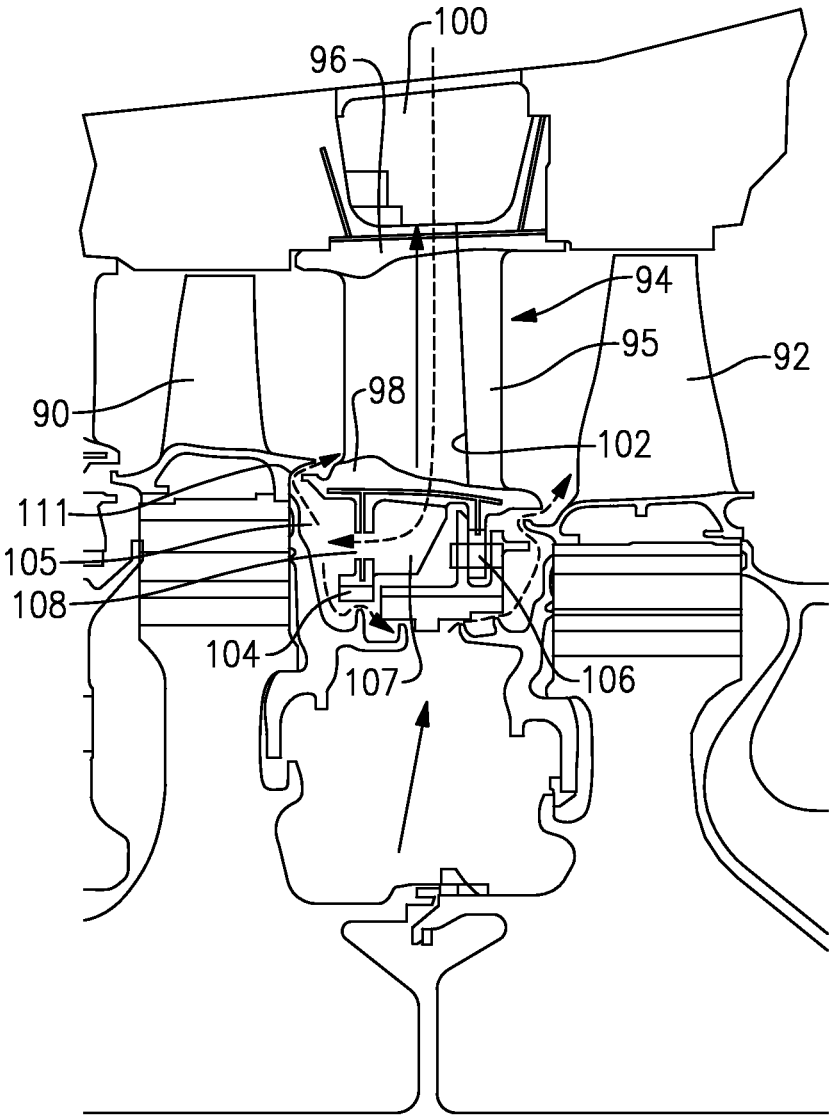
FIG. 2 shows a turbine section.

FIG. 2 shows a detail of a turbine section. Rotating turbine blade stages 90 and 92 are separated by an intermediate vane stage 94. The vane stage 94 is static, and includes a plurality of circumferentially spaced vanes 94. In an embodiment, the vane 94 has an airfoil 95 extending from an outer platform 96 to an inner platform 98. Cooling air is supplied to an outer chamber 100, and passes through a passage 102 in the airfoil 95, which is shown schematically, and into a radially an inner chamber 107 which is intermediate radially inwardly extending mount legs 104 and 106, which extend radially inwardly from the inner platform 98.

A hole 108 is formed in one leg 104, and delivers air from the chamber 107 into a chamber 105 between the vane 94 and the turbine rotor stage 90. Air from the chamber 105 passes across a gap 111 between the rotor blade 90 and the platform 98 of the vane 94.

Figure 3:
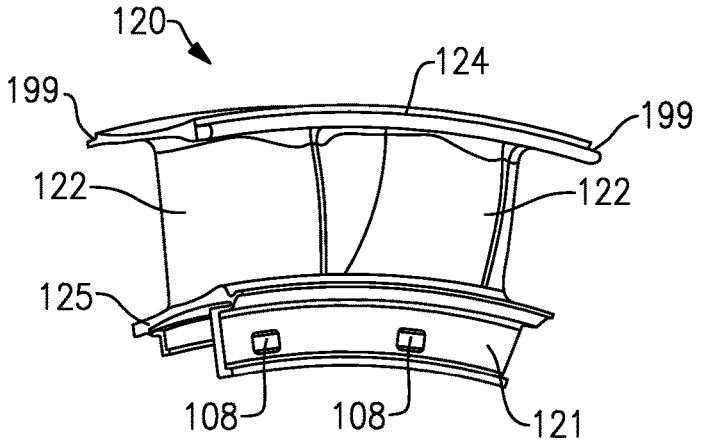
FIG. 3 shows a vane.

FIG. 3 shows a vane. The illustrated vane is a "duplex" vane, which includes two airfoils 122 extending from the outer platform 124 to the inner platform 125. The vane 94 as shown in FIG. 2 may in fact comprise a plurality of such duplex vane segments 120. Ends 199 define circumferential ends for the duplex vane segment 120. Air passes through the airfoils of the vanes 122 into the chamber 107 as in the FIG. 2 embodiment. The leg 121 is provided with an injector hole 108, which allows air from the chamber 107 to flow into the chamber 105 (see FIG. 2). Each airfoil 122 has a single hole 108.

As mentioned above, the single large injector hole 108 for each airfoil 122 creates a relatively high momentum to the air leaving the hole 108 and entering the chamber 105.

Figure 4:
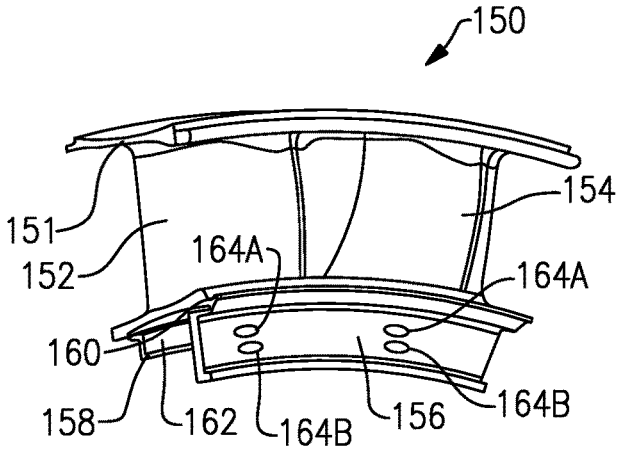
FIG. 4 shows a vane, according to an embodiment.

FIG. 4 shows a duplex vane 150, according to an embodiment. While duplex vane 150 is shown with two airfoils 152 and 154, this various embodiments would extend to vanes formed as a continuous circumferential ring, single vanes, or any other arrangement of vanes. An outer platform 151 communicates air into the airfoils 152 and 154, and through passages such as shown in FIG. 2 into a chamber 162 between legs 156 and 158, which extend radially inwardly from an inner platform 160. A hole 164A is spaced radially outwardly of a hole 164B. There are a set of two such holes for each of the airfoils 152 and 154. While the holes are shown to be generally elliptical, they may be round, rectangular, or a combination of shapes. In various embodiments any number of additional holes and passages may be used.

Since a plurality of holes 164A and 164B are utilized, the holes can extend for a smaller cross-sectional area, and for a smaller circumferential width than the single holes 108. The air leaving the hole will have a lower momentum than would be the case with the FIG. 3 vane. This produces a stream of air that is quickly smeared by air swirling with the rotating rotor blade 90 and in the chamber 105. Thus, the chamber 105 is uniformly cooled.

Figure 5A:
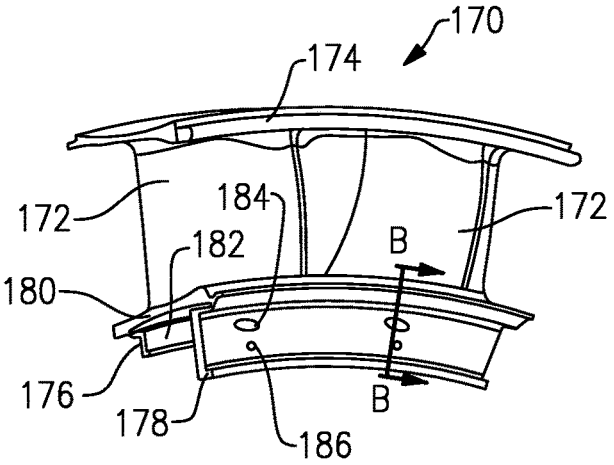
FIG. 5A shows a vane according to an additional embodiment.

FIG. 5A depicts an embodiment 170 wherein two airfoils 172 extend between a platform 174 and a platform 180. A chamber 182 is formed between legs 176 and 178. It should be understood that a housing element such as chamber 200 in FIG. 2 may be utilized with the FIGS. 4 and 5A embodiments.

A radially outer hole 184 and a radially inner hole 186 are shown in the leg 178. As shown, the holes are of different cross-sectional sizes, and of different shapes.

Figure 5B:
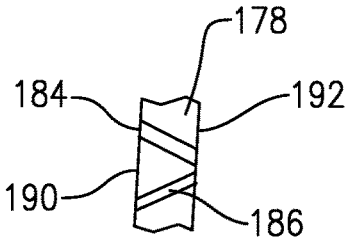
FIG. 5B shows a detail along line B-B of FIG. 5A, according to an embodiment.

FIG. 5B depicts another element of the airfoils according to an additional embodiment. The leg 178 has an axially inner face 190 and an axially outer face 192. Each hole 184 and 186 extends from the inner face 190 to the outer face 192. The hole 184 is shown to be extending at a non-parallel angle (such as defined by the center axis A of the engine and as shown in FIG. 1). The hole 186 is illustrated as extending at an angle that is radially outward and non-parallel to the center axis A. As is clear, the holes 184 and 186 extend at angles that coverage toward each other from inner wall 190 to outer wall 192. By utilizing the distinct angles, sizes and shapes, a designer can achieve an ideal direction and flow, mix rate, and direction for the air leaving the vanes, and entering chamber 105.

Also, as can be seen, 164A and 164B are circumferentially aligned, as are holes 184 and 186.

Figure 6:
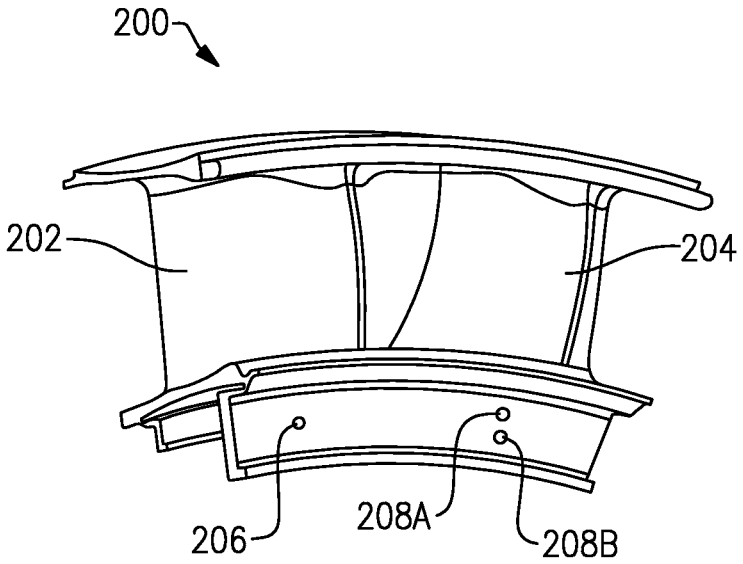
FIG. 6 shows another embodiment wherein a first vane is provided with a different number of holes than a second vane.

FIG. 6 shows an embodiment 200 wherein the duplex airfoils 202 and 204 have one airfoil 204 provided with a pair of holes 208A and 208B, while the airfoil 202 is provided with a single hole 206. In certain applications, it may be that one airfoil may benefit more from the plural holes than one another.

Figure 7:
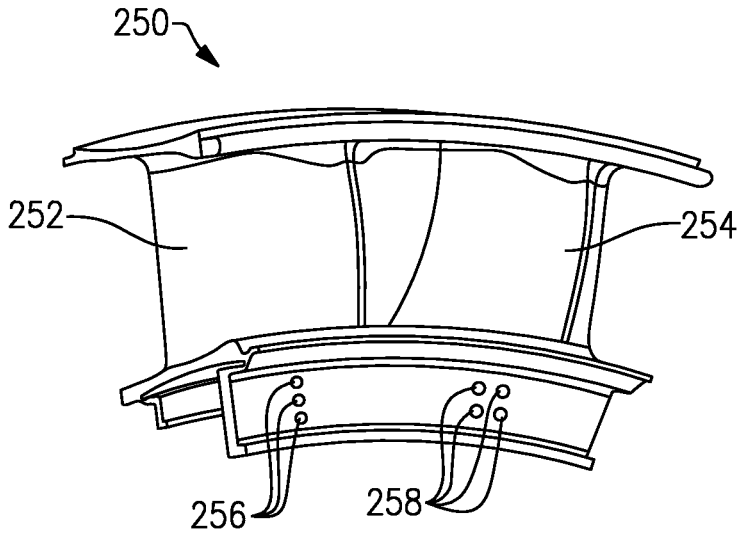
FIG. 7 shows yet another embodiment wherein two vanes have a different number of holes.

FIG. 7 shows another embodiment 250 wherein an airfoil 252 is provided with a first number of holes 256 (here three), and a second airfoil 254 is provided with a distinct number (here four). Again, a particular location for the particular airfoils may dictate a distinct number of holes should be utilized.

Although embodiments of this invention have been disclosed, a worker of ordinary skill in this art would recognize that certain modifications would come within the scope of this disclosure. For that reason, the following claims should be studied to determine the true scope and content of this disclosure.

The invention claimed is:

1. A vane comprising:

an airfoil extending from a radially outer platform to a radially inner platform;

a pair of legs extending radially inwardly from said radially inner platform, and an air flow passage extending through said radially outer platform, through said airfoil, and into a chamber defined between said pair of legs, one of said pair of legs including a plurality of injector holes, configured to allow air from said radially outer platform to pass outwardly of said holes;

at least one of said plurality of holes extends at an angle that is non-parallel to a central axis of an engine incorporating said vane;

wherein said plurality of holes includes a pair of holes, a first hole positioned radially outwardly of a second hole;

wherein each of said pair of holes extend at an angle that is non-parallel to the central axis of the engine; and wherein said angles through which said pair of holes extend are also non-parallel to each other, and said pair of holes extend from an inner wall to an outer wall, and said angles are such that said pair of holes extend toward each other from said inner wall to said outer wall.

2. The vane as set forth in claim 1, wherein said pair of holes have distinct shapes.

3. The vane as set forth in claim 2, wherein said pair of holes have distinct sizes and cross-sectional areas.

4. The vane as set forth in claim 1, further including a second airfoil extending between said radially outer platform and said radially inner platform, and each of said airfoil and said second airfoil include a plurality of injector holes.

5. The vane as set forth in claim 4, wherein said holes associated with at least one of said airfoil and said second airfoil have distinct sizes and cross-sectional areas.

6. The vane as set forth in claim 1, wherein said angle of said first of said pair of holes extends radially inwardly, and said angle of said second of said pair of holes extends radially outwardly.

7. A gas turbine engine comprising:

at least one static vane stage; and a vane in said at least one static vane stage including a radially outer platform, a radially inner platform, and an airfoil extending from said radially outer platform to said radially inner platform, and a pair of legs extending radially inwardly from said radially inner platform, the vane including an air flow passage extending through said radially outer platform, through said airfoil, and into a chamber defined between said pair of legs, one of said pair of legs including a plurality of injector holes associated with said airfoil, configured to allow air from said radially outer platform to pass outwardly of said holes;

at least one of said plurality of holes extends at an angle that is non-parallel to a central axis of the engine;

wherein said plurality of holes includes a pair of holes, a first hole positioned radially outwardly of a second hole;

wherein each of said pair of holes extend at an angle that is non-parallel to the central axis of the engine; and wherein said angles through which said pair of holes extend are also non-parallel to each other, and said pair of holes extend from an inner wall to an outer wall, and said angles are such that said pair of holes extend toward each other from said inner wall to said outer wall.

8. The gas turbine engine as set forth in claim 7, wherein said pair of holes have distinct shapes.

9. The gas turbine engine as set forth in claim 8, wherein said pair of holes have distinct sizes and cross-sectional areas.

10. The gas turbine engine as set forth in claim 7, further including a second airfoil extending between said radially outer platform and said radially inner platform, and each of said airfoil and said second airfoil include a plurality of injector holes.

11. The gas turbine engine as set forth in claim 10, wherein said holes associated with at least one of said airfoil and said second airfoil have distinct sizes and cross-sectional areas.

12. The gas turbine engine as set forth in claim 11, wherein each of said holes associated with at least one of said airfoil and said second airfoil extend at an angle that is non-parallel to the central axis of the engine.

13. The gas turbine engine as set forth in claim 7, wherein said angle of said first of said pair of holes extends radially inwardly, and said angle of said second of said pair of holes extends radially outwardly.

* * * * *